US010847107B2

(12) United States Patent
Zhang et al.

(10) Patent No.: US 10,847,107 B2
(45) Date of Patent: Nov. 24, 2020

(54) GATE DRIVER ON ARRAY CIRCUIT, DISPLAY PANEL AND DISPLAY DEVICE

(71) Applicant: WUHAN CHINA STAR OPTOELECTRONICS TECHNOLOGY CO., LTD., Wuhan (CN)

(72) Inventors: Xin Zhang, Wuhan (CN); Juncheng Xiao, Wuhan (CN); Yanqing Guan, Wuhan (CN)

( * ) Notice: Subject to any disclaimer, the term of this patent is extended or adjusted under 35 U.S.C. 154(b) by 18 days.

(21) Appl. No.: 16/342,977

(22) PCT Filed: Dec. 27, 2018

(86) PCT No.: PCT/CN2018/124282

§ 371 (c)(1),
(2) Date: Apr. 18, 2019

(87) PCT Pub. No.: WO2020/107610

PCT Pub. Date: Jun. 4, 2020

(65) Prior Publication Data

US 2020/0273418 A1 Aug. 27, 2020

(30) Foreign Application Priority Data

Nov. 30, 2018 (CN) ..... 2018 1 1460166

(51) Int. Cl.
*G09G 3/36* (2006.01)

(52) U.S. Cl.
CPC ... *G09G 3/3677* (2013.01); *G09G 2300/0408* (2013.01); *G09G 2310/0283* (2013.01); *G09G 2310/06* (2013.01)

(58) Field of Classification Search
None
See application file for complete search history.

(56) References Cited

U.S. PATENT DOCUMENTS

2016/0224175 A1* 8/2016 Moon ..... G06F 3/0412
2019/0096500 A1* 3/2019 Gu ..... G09G 3/20

* cited by examiner

*Primary Examiner* — Matthew Yeung

(57) ABSTRACT

The invention provides a GOA circuit, a display panel and a display device. The GOA circuit includes: a first voltage stabilizing module, including a first capacitor and a second capacitor, and one end of the first capacitor is connected to a connection point between a forward scan control signal and a forward and reverse scan control module; one end of the second capacitor is connected to a connection point between a reverse scan control signal and the forward and reverse scan control module.

20 Claims, 3 Drawing Sheets

GATE DRIVER ON ARRAY CIRCUIT, DISPLAY PANEL AND DISPLAY DEVICE

FIELD OF THE INVENTION

The present invention relates to a display field, and more particularly to a gate driver on array circuit, a display panel and a display device.

BACKGROUND OF THE INVENTION

At present, the liquid crystal display device has been widely used in various electronic products, and the GOA (Gate Driver On Array) circuit is an important component of the liquid crystal display device. The Gate row scan driving signal circuit is fabricated on the array substrate by utilizing the existing array process of the thin film transistor liquid crystal display to realize a technique of Gate progressive scan driving.

The display panel based on low temperature polysilicon (LTPS) technology can be classified into an NMOS type, a PMOS type and a CMOS type having both NMOS type TFT and PMOS type TFT according to the type of thin film transistor (TFT) used in the panel. Similarly, GOA circuits are divided into an NMOS circuit, a PMOS circuit and a CMOS circuit. Compared with the CMOS circuit, the NMOS circuit saves the product yield and reduces the cost by eliminating the mask and the process of P doping layer.

Compared with the CMOS type GOA circuit, the stability of the NMOS GOA circuit or the PMOS type GOA circuit is easily disturbed by the display area, particularly when the picture is reloaded (such as pixel dot inversion), the input signal fluctuates, which affects the fluctuation of the stage transfer signal of the next stage GOA unit and affects the stability of the voltage level of point Q. Accordingly, the normal stage transfer function cannot be realized, which makes the GOA circuit ineffective. Especially, it occurs more easily in medium and large size liquid crystal display devices.

Therefore, there is a need to provide a gate driver on array circuit, a display panel and a display device to solve the existing problems of the prior art.

SUMMARY OF THE INVENTION

An objective of the present invention is to provide a gate driver on array (GOA) circuit, a display panel and a display device, which can improve the stability of the gate driver on array circuit.

For solving the aforesaid issues, the present invention provides a GOA circuit, including:

m cascaded GOA units, wherein an nth stage GOA unit includes: a first voltage stabilizing module, configured to maintain a voltage level of a first node when an input signal of the GOA circuit fluctuates; wherein the first voltage stabilizing module includes a first capacitor and a second capacitor, and one end of the first capacitor is connected to a connection point between a forward scan control signal and a forward and reverse scan control module; one end of the second capacitor is connected to a connection point between a reverse scan control signal and the forward and reverse scan control module;

wherein the forward and reverse scan control module is configured to control the GOA circuit to perform forward scan or reverse scan according to the forward scan control signal or the reverse scan control signal;

a node signal control module, configured to control the GOA circuit to output a gate driving signal of low voltage level during a non-working stage according to an n+1th stage clock signal and an n−1th stage clock signal; wherein $m \geq n \geq 1$;

an output control module, configured to control an output of a gate driving signal of a current stage according to a clock signal of the current level;

a second voltage stabilizing module, configured to maintain a voltage level of the first node;

a first pull-down module, configured to pull down the voltage level of the first node;

a second pull-down module, configured to pull down a voltage level of a second node; and a third pull-down module, configured to pull down a voltage level of the gate driving signal of the current stage.

The present invention further provides a liquid crystal panel, including any one of the foregoing GOA circuits.

The present invention further provides a display device, including the foregoing liquid crystal panel.

In the GOA circuit, the display panel and the display device of the present invention, the voltage level of the first node is maintained when the input signal of the GOA circuit fluctuates by adding the first voltage stabilizing module, thereby preventing the voltage level of the Q point from being pulled down. The normal stage transfer function is realized, and the stability of the GOA circuit is increased.

DETAILED DESCRIPTION OF PREFERRED EMBODIMENTS

Figure 1:
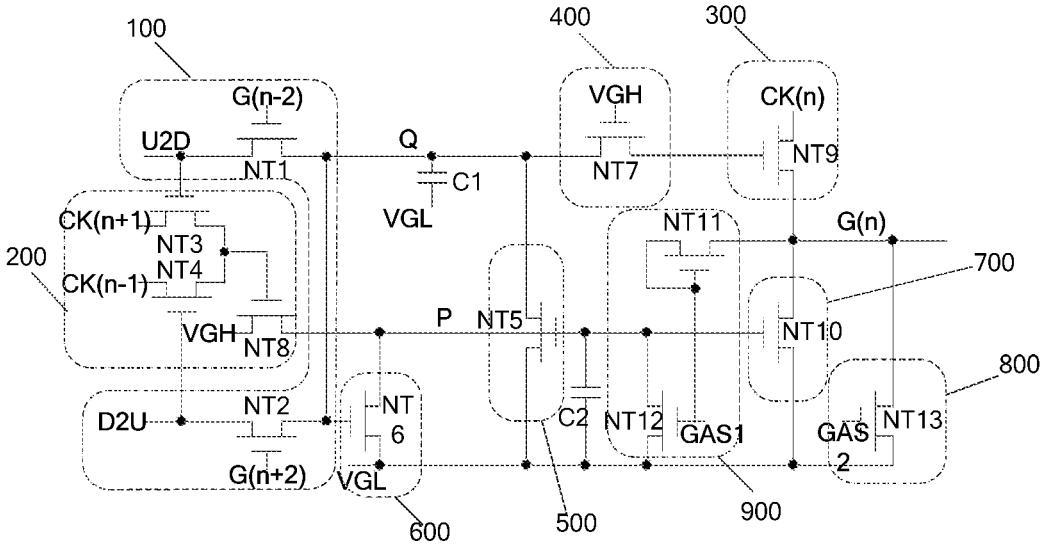
FIG. 1 is a structural diagram of a gate driver on array (GOA) circuit according to the prior art.

The following descriptions for the respective embodiments are specific embodiments capable of being implemented for illustrations of the present invention with referring to appended figures. The terms of up, down, front, rear, left, right, interior, exterior, side, etcetera mentioned in the present invention are merely directions of referring to appended figures. Thus, the used directional terms are used to describe and understand the present invention, but the present invention is not limited thereto. In the figure, units with similar structures are denoted by the same reference numerals.

As shown in FIG. 1, the GOA circuit of the prior art includes m cascaded GOA unit. An nth stage GOA unit includes: a forward and reverse scan control module 100, a node signal control module 200, an output control module 300, a voltage stabilizing module 400, a first pull-down module 500, a second pull-down module 600, a third pull-down module 700, a fourth pull-down module 800, a pull-up module 900 and a third capacitor C1 and a fourth capacitor C2, wherein $m \geq n \geq 1$;

The forward and reverse scan control module 100 is configured to control the GOA circuit to perform forward scan or reverse scan according to a forward scan control signal U2D or a reverse scan control signal D2U. The node signal control module 200 is configured to control the GOA unit to output a gate driving signal of low voltage level during a non-working stage according to an n+1th stage clock signal CK(n+1) and an n−1th stage clock signal CK(n−1). The output control module 300 is configured to control an output of a gate driving signal of a current stage according to a clock signal CK(n) of the current stage. The first voltage stabilizing module 400 is configured to maintain a voltage level of a first node Q. The first pull-down module 500 is configured to pull down the voltage level of a first node Q. The second pull-down module 600 is configured to pull down a voltage level of a second node P. The third pull-down module 700 is configured to pull down a voltage level of the gate driving signal G(n) of the current stage. The fourth pull-down module 800 is configured to pull down the level of the gate drive signal G(n) of the current stage when the display panel is in a second working state according to a second global signal GAS2. The pull-up module 900 is configured to control the GOA unit of the current stage to output a gate driving signal of a high voltage level when the display panel is in a first working state according to a first global signal GAS1. The first working state is a state of black screen touch operation or abnormal power failure. It can be understood that when the display panel is in the first working state, the first global signal GAS1 is at a high voltage level, and all GOA units output gate driving signals of a high voltage level. The second working state is a state in display touch operation period when the second global signal GAS2 is at a high voltage level.

When the display panel is in the forward scan state, U2D is high voltage level and D2U is low voltage level. At this time, the GOA circuit scans from top to bottom row by row. Conversely, when the display panel is in the reverse scan state, U2D is low voltage level and D2U is high voltage level. At this time, the GOA circuit scans from bottom to top row by row.

Figure 2:
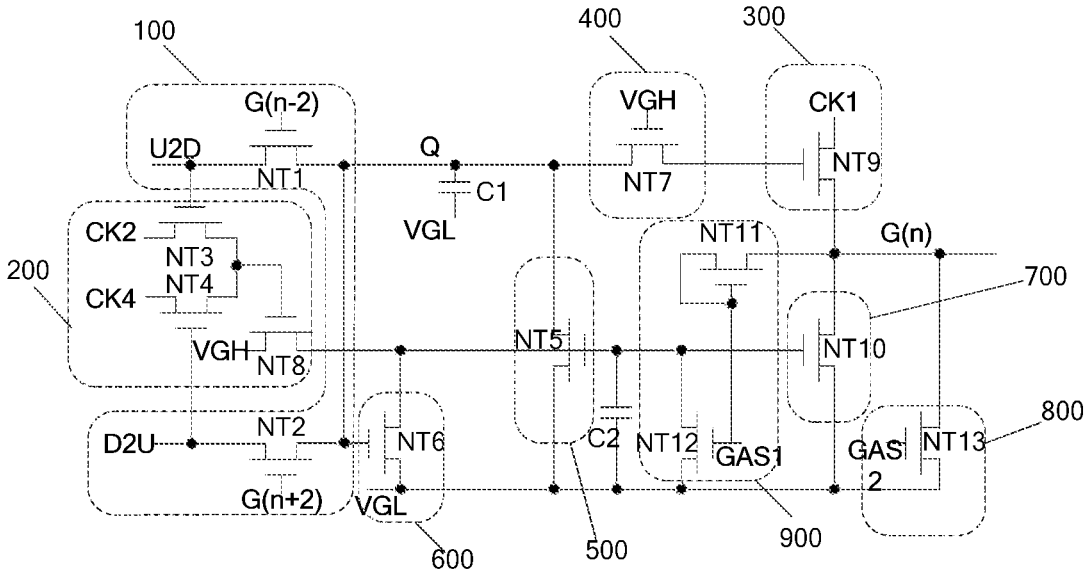
FIG. 2 is a structural diagram of an nth stage GOA unit in a GOA circuit according to the prior art.
Figure 3:
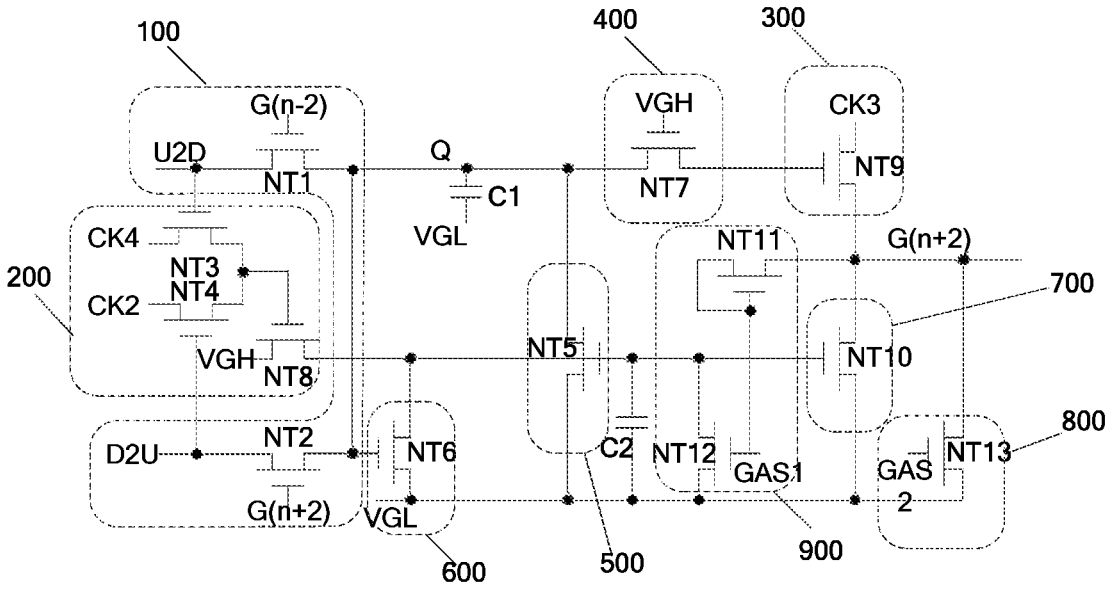
FIG. 3 is a structural diagram of an n+2th stage GOA unit in a GOA circuit according to the prior art.

The left side GOA circuit and the right GOA circuit are respectively disposed on both sides of the display panel. In one embodiment, the left GOA circuit drives odd rows of scan lines and the right GOA circuit drives even rows of scan lines. When the display panel has a 4CK architecture, the GOA circuit loops with two basic units as the smallest repeating unit. As shown in FIG. 2 and FIG. 3, the nth stage GOA unit and the n+2th stage GOA unit may together constitute one GOA repeating unit. Combining with FIG. 4, there are four clock signals CK in the GOA circuit: the first clock signal CK1 to the fourth clock signal CK4. When the nth stage clock signal of the nth stage GOA unit is the first clock signal CK1, the n+1th stage clock signal of the nth stage GOA unit is the second clock signal CK2, and the n−1th clock signal of the nth stage GOA unit is the fourth clock signal CK4. When the nth clock signal of the n+2th GOA unit is the third clock signal CK3, the n+1th clock signal of the n+2th GOA unit is the 4th clock signal, and the n−1th clock signal of the n+2th GOA unit is the second clock signal. It can be understood that if the node signal control module 200 of the nth stage GOA unit is correspondingly connected to the second clock signal and the fourth clock signal, the output control module 300 will be connected to the first clock signal. Then, the node signal control module 200 of the n+1th stage GOA unit is connected to the first clock signal and the third clock signal, and the output control module 300 is connected to the second clock signal. Certainly, the display panel can also have a 8CK architecture, the GOA circuit loops with four basic units as the smallest repeating unit.

Figure 4:
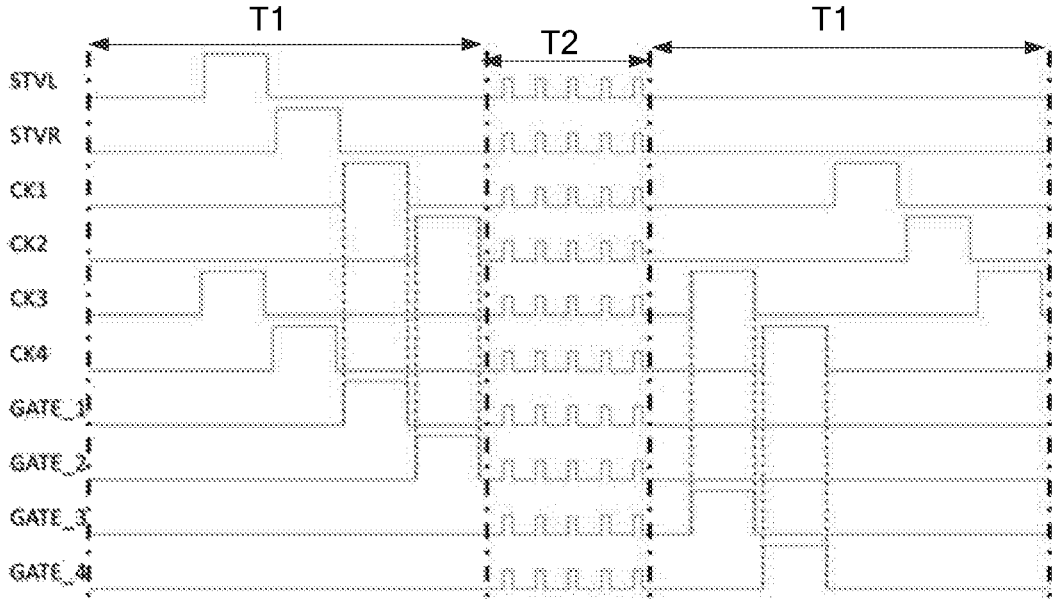
FIG. 4 is a timing diagram of a GOA circuit of a display panel of a 4CK architecture according to the prior art.

FIG. 4 is a timing diagram of a GOA circuit corresponding to a display panel of a 4CK architecture; the STV signal is a start signal of the GOA circuit, and STVL and STVR correspond to the left STV and the right STV, respectively, that is, STVL and STVR are a left start signal and a right start signal, respectively. The first global signal GAS1 and the second global signal GAS2 are both low voltage levels when the display panel is operating normally. The second global signal GAS2 is switched from the low voltage level to the high voltage level as the display period T1 is switched to the touch period T2.

GATE_1 to GATE_4 respectively indicate the first scan signal to the fourth scan signal, which correspond to the gate driving signals of the first stage GOA unit to the fourth stage GOA unit, respectively.

It can be understood that if the output control module 300 of the first stage GOA unit is connected to the first clock signal, the second stage GOA unit output control module 300 is connected to the second clock signal. The output control module 300 of the third stage GOA unit is connected to the third clock signal, and the output control module 300 of the fourth stage GOA unit is connected to the fourth clock signal, so when CK1 is high, G(1) is high voltage level, thus GATE_1 is also high voltage level. GATE_2 to GATE_4 are similar as aforementioned.

Returning to FIG. 1, under normal conditions, the voltage of VGL and the voltage of D2U are the same. When the picture is reloaded (such as pixel dot inversion), the display area is connected to the VGL signal through tenth thin film transistor NT10, and VGL is most affected by Couple of the display area. VGL has more fluctuations than the D2U signal. Therefore, the voltage of VGL and the voltage of D2U are the same but the instantaneous voltage of VGL affected by Couple is higher than that of D2U, so the G(N+2) signal is not pulled down. Since the gate of the thin film transistor NT2 of the next stage GOA unit is connected to G(N+2), there is a risk that the second thin film transistor NT2 is instantaneously activated. If the second thin film transistor NT2 is activated and point Q is high voltage level, the voltage level at point Q is released (pulled down), so it cannot continue to maintain at a high voltage level, and the normal stage transfer function cannot be realized, causing the failure of the GOA circuit.

Figure 5:
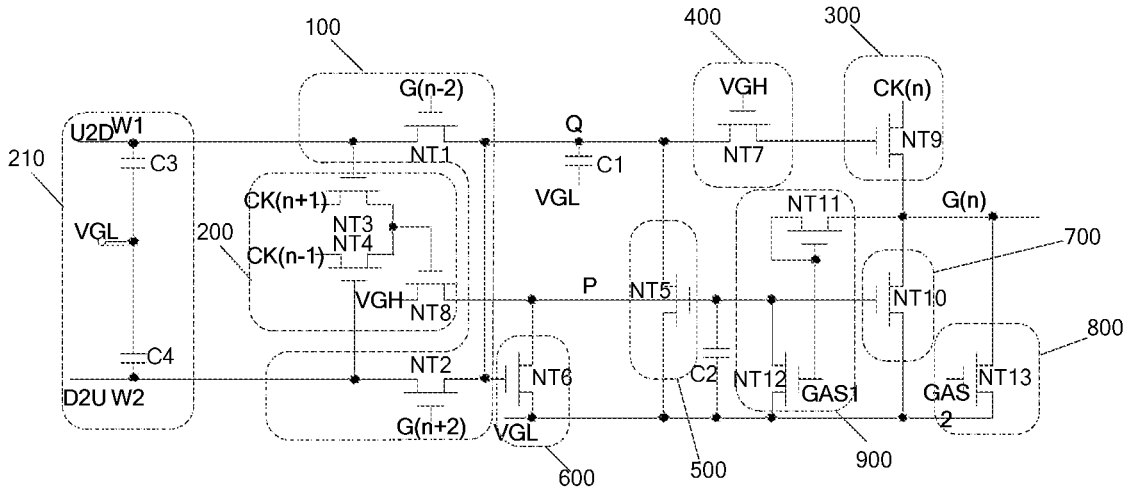
FIG. 5 is a structural diagram of a GOA circuit according to the present invention.

Please refer to FIG. 5. FIG. 5 is a structural diagram of a GOA circuit according to the first embodiment of the present invention.

As shown in FIG. 5, the GOA circuit of the present embodiment includes m cascaded GOA unit. An nth stage GOA unit includes: a first voltage stabilizing module 210, a forward and reverse scan control module 100, a node signal control module 200, an output control module 300, a second voltage stabilizing module 400, a first pull-down module 500, a second pull-down module 600, a third pull-down module 700. Moreover, the nth stage GOA unit may also includes a fourth pull-down module 800, a pull-up module 900, a third capacitor C1 and a fourth capacitor C2, wherein m≥n≥1.

The first voltage stabilizing module 210 is configured to maintain the voltage level of the first node when the input signal of the GOA circuit fluctuates (that is, when the picture is reloaded).

The functions of the rest modules are the same as those of FIG. 1.

The first voltage stabilizing module 210 includes a first capacitor C3 and a second capacitor C4, and one end of the first capacitor C3 is connected to a connection point W1 between the forward scan control signal U2D and the forward and reverse scan control module 100; one end of the second capacitor C4 is connected to a connection point W2 between the reverse scan control signal D2U and the forward and reverse scan control module 100.

The forward scan control module 200 includes a first thin film transistor NT1 and a second thin film transistor NT2;

a gate of the first thin film transistor NT1 is connected to a gate driving signal G(n−2) of the n−2th stage GOA unit, and a source of the first thin film transistor is connected to the forward scan control signal U2D, and a drain of the first thin film transistor is respectively connected to a drain of the second thin film transistor NT2, a second pull-down module 600 and the first node Q;

a source of the second thin film transistor NT2 is connected to the reverse scan control signal D2U, and a gate of the second thin film transistor is connected to a gate driving signal G(n+2) of a n+2th stage GOA unit.

The node signal control module 200 includes a third thin film transistor NT3, a fourth thin film transistor NT4 and an eighth thin film transistor NT8. A gate of the third thin film transistor NT3 is connected to the source of the first thin film transistor NT1, and a source of the third thin film transistor is connected to the n+1th stage clock signal, and a drain of the third thin film transistor is connected to a drain of the fourth thin film transistor NT4 and a gate of the eighth thin film transistor NT8. A gate of the fourth thin film transistor NT4 is connected to the source of the second thin film transistor NT2, and a source of the four thin film transistor is connected to the n−1th stage clock signal. A source of the eighth thin film transistor NT8 is connected to a constant voltage high potential signal VGH, and the drain of the eighth thin film transistor is connected to the second node P.

The second pull-down module 600 includes a sixth thin film transistor NT6, and a gate of the sixth thin film transistor NT6 is connected to the drain of the second thin film transistor NT2, and a source of the sixth thin film transistor is connected to a constant voltage low potential signal VGL, and a drain of the sixth thin film transistor is connected to the second node P.

One end of the third capacitor C1 is connected to the first node Q, and the other end of the third capacitor C1 is connected to the constant voltage low potential signal VGL.

The second voltage stabilizing module 400 includes a seventh thin film transistor NT7, and a gate of the seventh thin film transistor NT7 is connected to the constant voltage high potential signal VGH, and a source of the seventh thin film transistor is connected to the first node Q, and a drain of the seventh thin film transistor is connected to a gate of the ninth thin film transistor NT9.

The output control module 300 includes a ninth thin film transistor NT9, and a gate of the ninth thin film transistor NT9 is connected to the drain of the seventh thin film transistor NT7, and a source of the ninth thin film transistor is connected to the clock signal CK(n) of the current stage.

The first pull-down module 500 includes a fifth thin film transistor NT5, and a gate of the fifth thin film transistor NT5 is connected to the second node P, and a drain of the fifth thin film transistor is connected to the first node Q, and a source of the fifth thin film transistor is connected to the constant voltage low potential signal VGL.

The third pull-down module 700 includes a tenth thin film transistor NT10, and a gate of the tenth thin film transistor NT10 is connected to the second node P, and a source of the tenth thin film transistor is connected to the constant voltage low potential signal VGL, and a drain of the tenth thin film transistor is connected to drain of the ninth thin film transistor NT9.

The fourth pull-down module 800 includes a thirteenth thin film transistor NT13, and a gate of the thirteenth thin film transistor NT13 is connected to a second global signal GAS2, and a source of the thirteenth thin film transistor is connected to the constant voltage low potential signal VGL.

The pull-up module 900 includes an eleventh thin film transistor NT11 and a twelfth thin film transistor NT12. A gate and a source of the eleventh thin film transistor NT11 are connected. A gate of the twelfth thin film transistor NT12 and the gate of the eleventh thin film transistor NT11 are both connected to the first global signal GAS1. A source of the twelfth thin film transistor NT12 is connected to the constant voltage low potential signal VGL, and the drain of the twelfth thin film transistor is connected to the second node. A drain of the eleventh thin film transistor NT11 is connected to the drain of the ninth thin film transistor NT9, the drain of the tenth thin film transistor NT10 and the drain of the thirteenth thin film transistor NT13, respectively.

One end of the fourth capacitor C2 is connected to the second node P, and the other end is connected to the constant voltage low potential signal VGL.

Since the GOA circuit of the present invention is added with the first voltage stabilizing module, when the input signal of the GOA circuit fluctuates, VGL momentarily becomes high voltage level, and G(N+2) also changes synchronously with VGL. The gate of second thin film transistor NT2 of the next stage GOA unit is connected to G(N+2), and the source is inputted with VGL through the capacitor C4, so that the voltage difference between the gate and source of second thin film transistor NT2 is 0. Namely, the second thin film transistor NT2 is prevented from being activated. When point Q is high voltage level, the voltage level of point Q is prevented from being pulled down, so that point Q continues to maintain high voltage level. The normal stage transfer function is realized, and the reliability of the level transmission is enhanced, and the stability of the GOA circuit is improved.

The present invention further provides a display panel, including any one of the foregoing GOA circuits. The display panel can be a liquid crystal display panel for illustration.

The present invention further provides a display device, including the foregoing display panel.

In the GOA circuit, the display panel and the display device of the present invention, the voltage level of the first node is maintained when the input signal of the GOA circuit fluctuates by adding the first voltage stabilizing module, thereby preventing the voltage level of the Q point from being pulled down. The normal stage transfer function is realized, and the stability of the GOA circuit is increased.

In summary, although the above preferred embodiments of the present invention are disclosed, the foregoing preferred embodiments are not intended to limit the invention, those skilled in the art can make various kinds of alterations and modifications without departing from the spirit and scope of the present invention. Thus, the scope of protection of the present invention is defined by the scope of the claims.

What is claimed is:

1. A gate driver on array (GOA) circuit, including m cascaded GOA units, and an nth stage GOA unit includes:

a first voltage stabilizing module, configured to maintain a voltage level of a first node when an input signal of the GOA circuit fluctuates; wherein the first voltage stabilizing module includes a first capacitor and a second capacitor, and one end of the first capacitor is connected to a connection point between a forward scan control signal and a forward and reverse scan control module; one end of the second capacitor is connected to a connection point between a reverse scan control signal and the forward and reverse scan control module;

wherein the forward and reverse scan control module is configured to control the GOA circuit to perform forward scan or reverse scan according to the forward scan control signal or the reverse scan control signal;

a node signal control module, configured to control the GOA circuit to output a gate driving signal of low voltage level during a non-working stage according to an n+1th stage clock signal and an n−1th stage clock signal; wherein m≥n≥1;

an output control module, configured to control an output of a gate driving signal of a current stage according to a clock signal of the current level;

a second voltage stabilizing module, configured to maintain a voltage level of the first node;

a first pull-down module, configured to pull down the voltage level of the first node;

a second pull-down module, configured to pull down a voltage level of a second node; and a third pull-down module, configured to pull down a voltage level of the gate driving signal of the current stage.

2. The GOA circuit according to claim 1, wherein the forward scan control module includes a first thin film transistor and a second thin film transistor;

a source of the first thin film transistor is connected to the forward scan control signal, a gate of the first thin film transistor is connected to a gate driving signal of a n−2th stage GOA unit; a drain of the first thin film transistor is respectively connected to a drain of the second thin film transistor, a second pull-down module and the first node;

a source of the second thin film transistor is connected to the reverse scan control signal, and a gate of the second thin film transistor is connected to a gate driving signal of a n+2th stage GOA unit.

3. The GOA circuit according to claim 2, wherein the node signal control module includes a third thin film transistor, a fourth thin film transistor and an eighth thin film transistor;

a gate of the third thin film transistor is connected to the source of the first thin film transistor, and a source of the third thin film transistor is connected to the n+1th stage clock signal, and a drain of the third thin film transistor is connected to a drain of the fourth thin film transistor and a gate of the eighth thin film transistor;

a gate of the fourth thin film transistor is connected to the source of the second thin film transistor, and a source of the four thin film transistor is connected to the n−1th stage clock signal;

a source of the eighth thin film transistor is connected to a constant voltage high potential signal, and the drain of the eighth thin film transistor is connected to the second node.

4. The GOA circuit according to claim 3, wherein the second pull-down module includes a sixth thin film transistor, and a gate of the sixth thin film transistor is connected to the drain of the second thin film transistor, and a source of the sixth thin film transistor is connected to a constant voltage low potential signal, and a drain of the sixth thin film transistor is connected to the second node.

5. The GOA circuit according to claim 1, wherein the first pull-down module includes a fifth thin film transistor, and a gate of the fifth thin film transistor is connected to the second node, and a drain of the fifth thin film transistor is connected to the first node, and a source of the fifth thin film transistor is connected to the constant voltage low potential signal.

6. The GOA circuit according to claim 1, wherein the second voltage stabilizing module includes a seventh thin film transistor, and a gate of the seventh thin film transistor is connected to the constant voltage high potential signal, and a source of the seventh thin film transistor is connected to the first node.

7. The GOA circuit according to claim 6, wherein the output control module includes a ninth thin film transistor, and a gate of the ninth thin film transistor is connected to the drain of the seventh thin film transistor, and a source of the ninth thin film transistor is connected to the clock signal of the current stage.

8. The GOA circuit according to claim 7, wherein the third pull-down module includes a tenth thin film transistor, and a gate of the tenth thin film transistor is connected to the second node, and a source of the tenth thin film transistor is connected to the constant voltage low potential signal, and a drain of the tenth thin film transistor is connected to drain of the ninth thin film transistor.

9. A liquid crystal panel, including a gate driver on array (GOA) circuit, wherein the GOA circuit includes m cascaded GOA units, and an nth stage GOA unit includes:

a first voltage stabilizing module, configured to maintain a voltage level of a first node when an input signal of the GOA circuit fluctuates; wherein the first voltage stabilizing module includes a first capacitor and a second capacitor, and one end of the first capacitor is connected to a connection point between a forward scan control signal and a forward and reverse scan control module; one end of the second capacitor is connected to a connection point between a reverse scan control signal and the forward and reverse scan control module;

wherein the forward and reverse scan control module is configured to control the GOA circuit to perform forward scan or reverse scan according to the forward scan control signal or the reverse scan control signal;

a node signal control module, configured to control the GOA circuit to output a gate driving signal of low voltage level during a non-working stage according to an n+1th stage clock signal and an n−1th stage clock signal; wherein m≥n≥1;

an output control module, configured to control an output of a gate driving signal of a current stage according to a clock signal of the current level;

a second voltage stabilizing module, configured to maintain a voltage level of the first node;

a first pull-down module, configured to pull down the voltage level of the first node;

a second pull-down module, configured to pull down a voltage level of a second node; and a third pull-down module, configured to pull down a voltage level of the gate driving signal of the current stage.

10. The liquid crystal panel according to claim 9, wherein the forward scan control module includes a first thin film transistor and a second thin film transistor;

a source of the first thin film transistor is connected to the forward scan control signal, a gate of the first thin film transistor is connected to a gate driving signal of a n−2th stage GOA unit; a drain of the first thin film transistor is respectively connected to a drain of the second thin film transistor, a second pull-down module and the first node;

a source of the second thin film transistor is connected to the reverse scan control signal, and a gate of the second thin film transistor is connected to a gate driving signal of a n+2th stage GOA unit.

11. The liquid crystal panel according to claim 10, wherein the node signal control module includes a third thin film transistor, a fourth thin film transistor and an eighth thin film transistor;

a gate of the third thin film transistor is connected to the source of the first thin film transistor, and a source of the third thin film transistor is connected to the n+1th stage clock signal, and a drain of the third thin film transistor is connected to a drain of the fourth thin film transistor and a gate of the eighth thin film transistor;

a gate of the fourth thin film transistor is connected to the source of the second thin film transistor, and a source of the four thin film transistor is connected to the n−1th stage clock signal;

a source of the eighth thin film transistor is connected to a constant voltage high potential signal, and the drain of the eighth thin film transistor is connected to the second node.

12. The liquid crystal panel according to claim 11, wherein the second pull-down module includes a sixth thin film transistor, and a gate of the sixth thin film transistor is connected to the drain of the second thin film transistor, and a source of the sixth thin film transistor is connected to a constant voltage low potential signal, and a drain of the sixth thin film transistor is connected to the second node.

13. The liquid crystal panel according to claim 9, wherein the first pull-down module includes a fifth thin film transistor, and a gate of the fifth thin film transistor is connected to the second node, and a drain of the fifth thin film transistor is connected to the first node, and a source of the fifth thin film transistor is connected to the constant voltage low potential signal.

14. The liquid crystal panel according to claim 9, wherein the second voltage stabilizing module includes a seventh thin film transistor, and a gate of the seventh thin film transistor is connected to the constant voltage high potential signal, and a source of the seventh thin film transistor is connected to the first node.

15. The liquid crystal panel according to claim 14, wherein the output control module includes a ninth thin film transistor, and a gate of the ninth thin film transistor is connected to the drain of the seventh thin film transistor, and a source of the ninth thin film transistor is connected to the clock signal of the current stage.

16. The liquid crystal panel according to claim 14, wherein the third pull-down module includes a tenth thin film transistor, and a gate of the tenth thin film transistor is connected to the second node, and a source of the tenth thin film transistor is connected to the constant voltage low potential signal, and a drain of the tenth thin film transistor is connected to drain of the ninth thin film transistor.

17. A display device, including a liquid crystal panel, wherein the liquid crystal panel includes a gate driver on array (GOA) circuit, and the GOA circuit includes m cascaded GOA units, and an nth stage GOA unit includes:

a first voltage stabilizing module, configured to maintain a voltage level of a first node when an input signal of the GOA circuit fluctuates; wherein the first voltage stabilizing module includes a first capacitor and a second capacitor, and one end of the first capacitor is connected to a connection point between a forward scan control signal and a forward and reverse scan control module; one end of the second capacitor is connected to a connection point between a reverse scan control signal and the forward and reverse scan control module;

wherein the forward and reverse scan control module is configured to control the GOA circuit to perform forward scan or reverse scan according to the forward scan control signal or the reverse scan control signal;

a node signal control module, configured to control the GOA circuit to output a gate driving signal of low voltage level during a non-working stage according to an n+1th stage clock signal and an n−1th stage clock signal; wherein m≥n≥1;

an output control module, configured to control an output of a gate driving signal of a current stage according to a clock signal of the current level;

a second voltage stabilizing module, configured to maintain a voltage level of the first node;

a first pull-down module, configured to pull down the voltage level of the first node;

a second pull-down module, configured to pull down a voltage level of a second node; and a third pull-down module, configured to pull down a voltage level of the gate driving signal of the current stage.

18. The display device according to claim 17, wherein the forward scan control module includes a first thin film transistor and a second thin film transistor;

a source of the first thin film transistor is connected to the forward scan control signal, a gate of the first thin film transistor is connected to a gate driving signal of a n−2th stage GOA unit; a drain of the first thin film transistor is respectively connected to a drain of the second thin film transistor, a second pull-down module and the first node;

a source of the second thin film transistor is connected to the reverse scan control signal, and a gate of the second thin film transistor is connected to a gate driving signal of a n+2th stage GOA unit.

19. The display device according to claim 18, wherein the node signal control module includes a third thin film transistor, a fourth thin film transistor and an eighth thin film transistor;

a gate of the third thin film transistor is connected to the source of the first thin film transistor, and a source of the third thin film transistor is connected to the n+1th stage clock signal, and a drain of the third thin film transistor is connected to a drain of the fourth thin film transistor and a gate of the eighth thin film transistor;

a gate of the fourth thin film transistor is connected to the source of the second thin film transistor, and a source of the four thin film transistor is connected to the n−1th stage clock signal;

a source of the eighth thin film transistor is connected to a constant voltage high potential signal, and the drain of the eighth thin film transistor is connected to the second node.

20. The display device according to claim 19, wherein the second pull-down module includes a sixth thin film transistor, and a gate of the sixth thin film transistor is connected to the drain of the second thin film transistor, and a source of the sixth thin film transistor is connected to a constant voltage low potential signal, and a drain of the sixth thin film transistor is connected to the second node.

* * * * *